United States Patent [19]

Seaholm et al.

[11] 4,364,203

[45] Dec. 21, 1982

[54] MODULAR SHEET METAL DOOR STRUCTURE

[75] Inventors: Reuel A. Seaholm; Stephen W. Smith, both of Arkansas City, Kans.

[73] Assignee: Montgomery Elevator Company, Moline, Ill.

[21] Appl. No.: 207,063

[22] Filed: Nov. 6, 1980

[51] Int. Cl.[3] ..... E05D 13/02

[52] U.S. Cl. ..... 49/409; 52/802; 52/821

[58] Field of Search ..... 49/409–412, 49/501; 52/801, 802, 814, 821, 822, 829

[56] References Cited

U.S. PATENT DOCUMENTS

| | | | |
|---|---|---|---|
| 973,622 | 10/1910 | Budd . | |
| 999,533 | 8/1911 | Weitzel . | |
| 1,410,539 | 3/1922 | Wine . | |
| 1,726,794 | 9/1929 | Anetsberger et al. | 49/409 |
| 2,045,291 | 6/1936 | Busse | 189/46 |
| 2,710,080 | 6/1955 | Negy | 49/382 X |
| 3,156,020 | 11/1964 | Horgan, Jr. | 20/19 |
| 3,185,112 | 5/1965 | Johnston | 52/801 X |
| 4,030,246 | 6/1977 | Naylor | 52/814 |
| 4,031,664 | 6/1977 | Wendt | 49/409 |

FOREIGN PATENT DOCUMENTS

| | | | |
|---|---|---|---|
| 725414 | 1/1966 | Canada | 49/409 |

*Primary Examiner*—Kenneth Downey

*Attorney, Agent, or Firm*—Wegner, McCord, Wood & Dalton

[57] ABSTRACT

A modular sheet metal door structure consists of a plurality of upright modules of the same length which are fixedly connected to one another and have coplanar main webs forming one face of the door. A sheet metal sheath fixedly connected to side webs of the modules forms the other face of the door and has upright marginal portions which closely embrace the modules to form upright door sides. Identical sheet metal header means are fixedly secured to the ends of the modules to provide the ends of the door, and the header means are constructed to be detachably connected to stems by which the door may be suspended from track-mounted carriages for sidewise movement with either end of the door up.

26 Claims, 9 Drawing Figures

MODULAR SHEET METAL DOOR STRUCTURE

BACKGROUND OF THE INVENTION

The vast majority of elevator doors and elevator hatchway doors are of a steel frame and metal panel construction and are hung from carriages for sidewise, sliding movement in the space between the elevator car and the wall of the hatchway flanking the corridor entranceway. Attempting to maintain a stock of such doors which may be finished to match the decor of a passenger elevator car and a building hallway presents a severe inventory problem, because of the several varieties of doors which are used, and the various widths of the corridor entranceways in different buildings. p The principal factor in the problem is that, depending upon the wishes of the building owner or architect, the hatchway and car may be supplied with a one-piece door that opens to one side, a door that opens to one side but consists of two narrower elements which open to a position in which they are in overlapping, face-to-face relationship; or they may be supplied with a pair of center opening doors or center opening doors each of which consists of two door elements. In addition to those four basic door patterns, door openings may be of different widths and heights.

SUMMARY OF THE INVENTION

In accordance with the present invention, a sheet metal door is fabricated from a set of standard, sheet metal modules which are positioned side by side and extend vertically. Each module consists of a main web that forms a part of an unfinished surface of the door, and side webs perpendicular to the main web. The modules have their main webs coplanar and their side webs side by side. A one-piece sheet metal sheath has a body which forms the entire surface of the door opposite that provided by the module main webs, and the sheath has upright marginal portions which closely embrace the modules to provide the sides of the door. Means, preferably welding, fixedly connect the modules to one another and to the sheath. Identical sheet metal headers are fixedly secured to the upper and lower ends of the modules to provide the ends of the door so that either end may be uppermost.

The modular door structure as above described is particularly adapted to elevator hatchway and car doors, because only the side of the hatchway door which is toward the corridor and the side of the car door which is toward the car must present a finished appearance. The rear side of the hatchway door is always concealed by the car door and the forward side of the car door is always concealed by the hatch door. At least one of the upright door sides must also present a finished appearance.

For an elevator hatch door or car door, the identical headers at the top and bottom of the door consist of a box beam which has a continuous slot in one side flanked by parallel, inturned webs; and the slotted sides of the box beams form the upper and lower extremities of the door. The door may be suspended from a carriage by means of threaded hanger bolts which screw into a hanger plate that bears against the underside of the inturned webs of the top header.

Finally, in order to simplify the connection of a door operating mechanism to the hatchway door and the car door, at least some of the sheet metal modules are provided with keyhole shaped knockouts in a pattern which permits a few of the knockouts to be removed to handle the mounting of any particular type of operating mechanism. Commonly the door operating mechanism is supported on the top of the elevator car, and is connected by a system of levers to the car door for the purpose of opening that door. There is a detachable operating connection between the car door and the hatch door, so that when the car door is opened or closed it carries the hatch door with it. Elevator manufacturers, of course, have their own operating mechanisms which have different driving connections to the car door and between the car door and the hatch door, so that if a door is to be usable in installations of different elevator manufacturers, it must be capable of receiving operating mechanisms which are mounted in different ways.

THE DRAWINGS

DETAILED DESCRIPTION OF THE INVENTION

Figure 1:
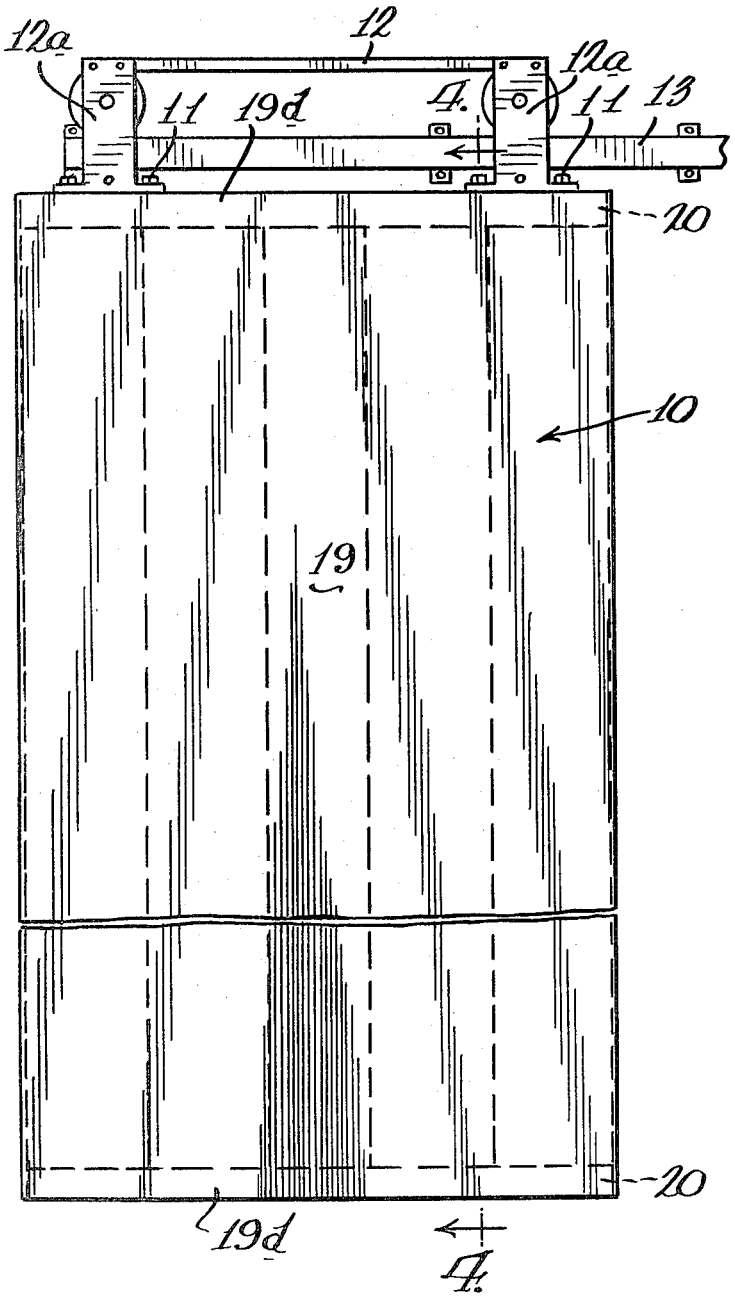
FIG. 1 is a fragmentary front elevational view of an elevator door embodying the invention.
Figure 4:
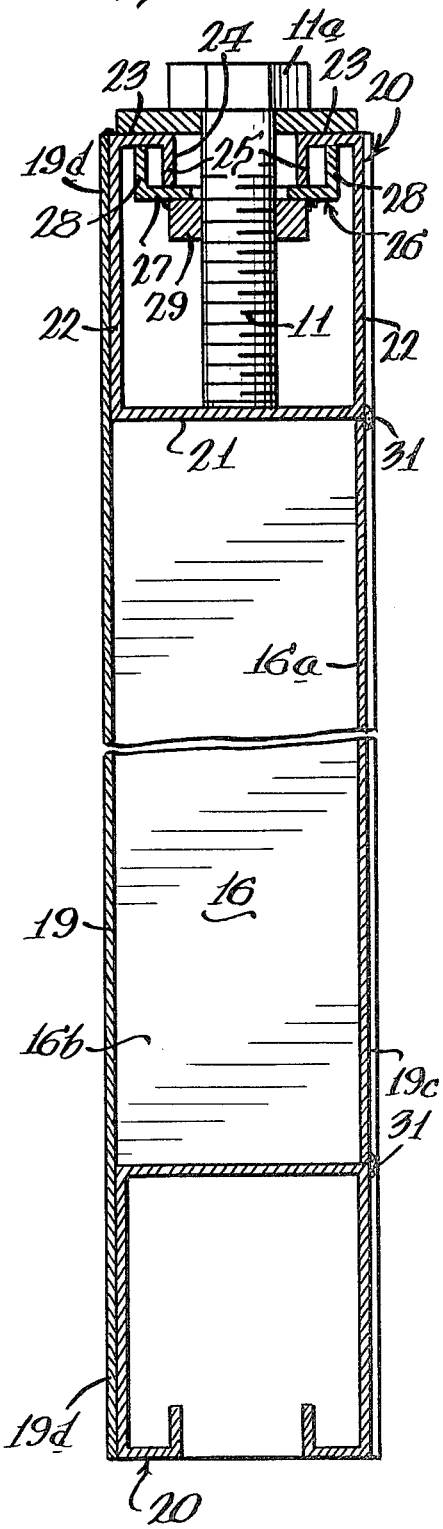
FIG. 4 is a fragmentary sectional view on an enlarged scale, taken substantially as indicated along the line 4—4 of FIG. 1.
Figure 2:
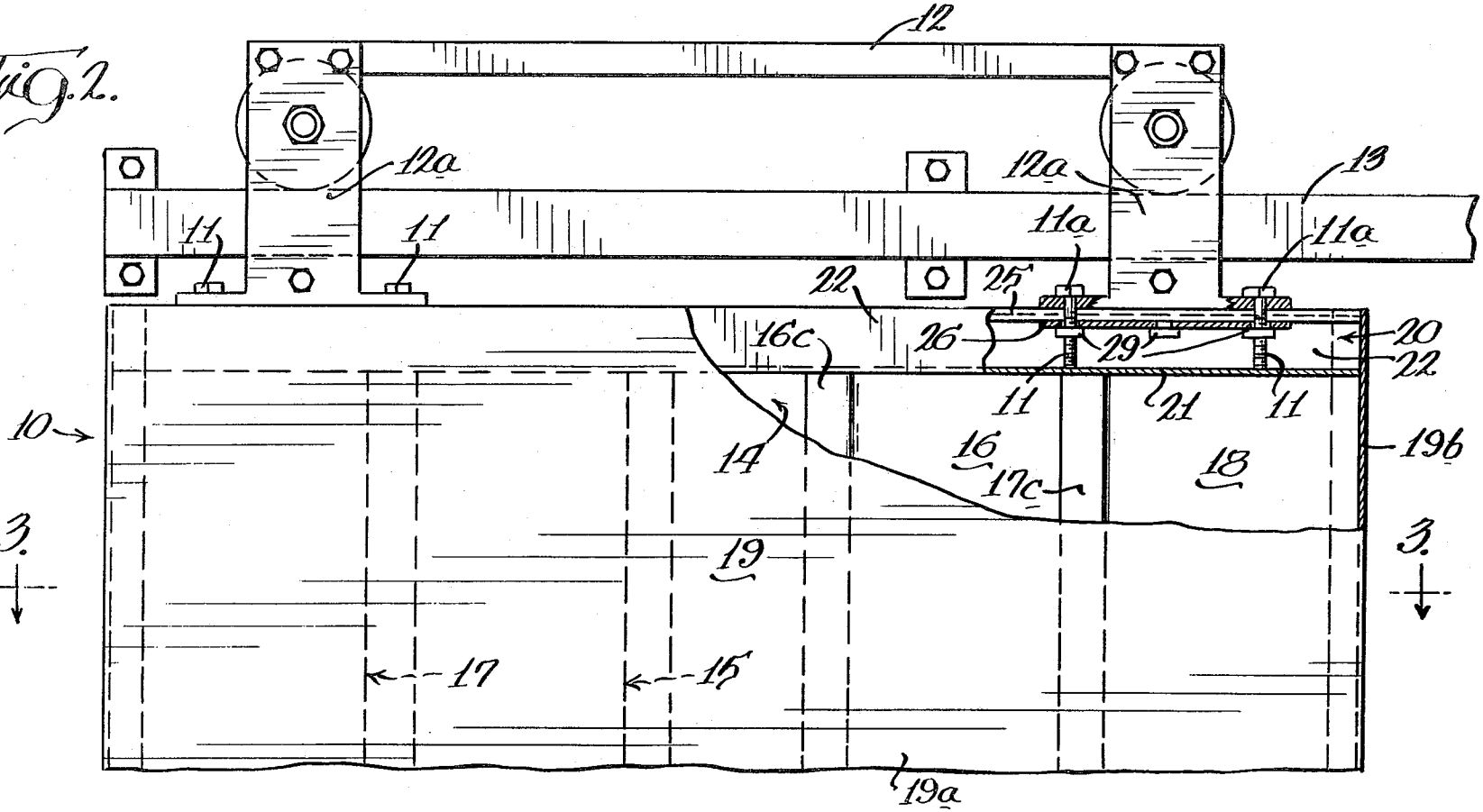
FIG. 2 is a fragmentary view similar to FIG. 1, on an enlarged scale, partly in section.
Figure 3:
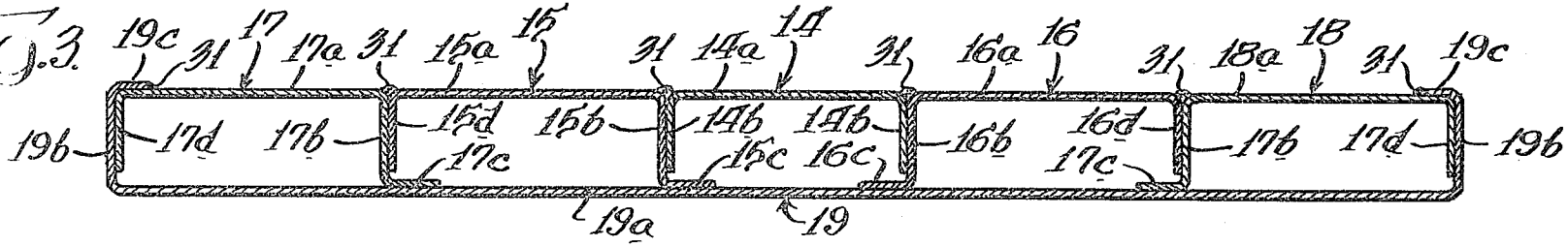
FIG. 3 is a transverse sectional view taken substantially as indicated along the line 3—3 of FIG. 2.
Figure 5:
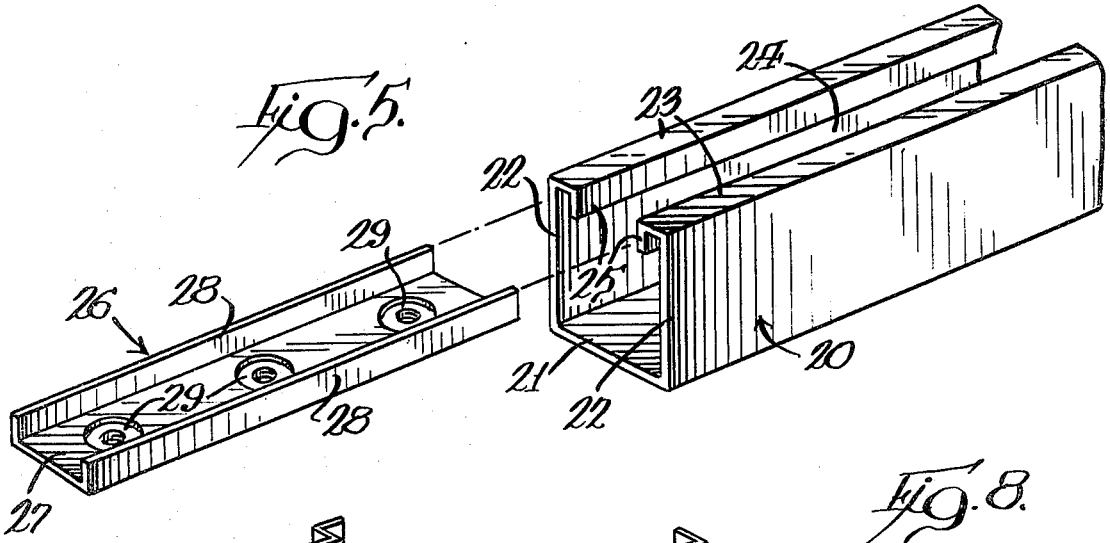
FIG. 5 is a fragmentary view of a header and hanger plate for suspending the door.
Figure 6:
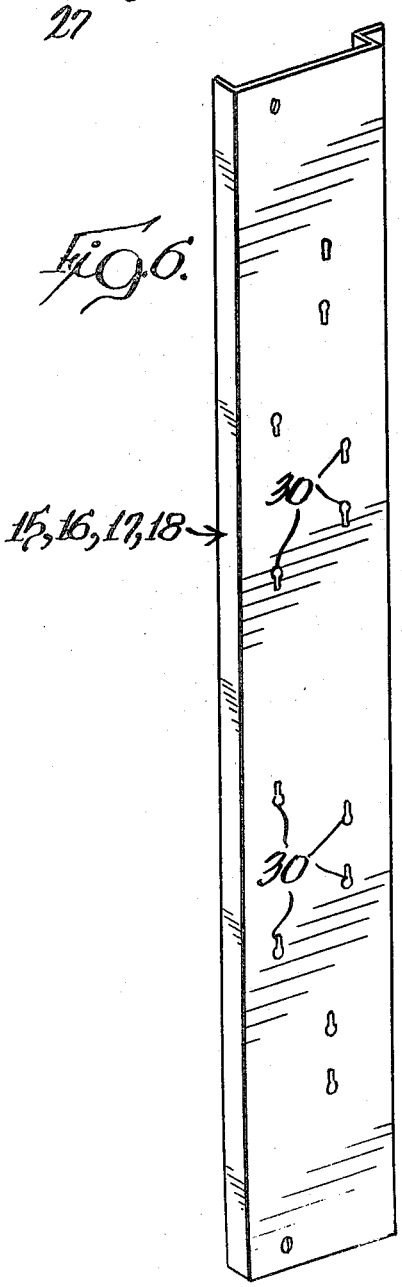
FIGS. 6 and 7 are fragmentary perspective views of two types of modules used in the structure.
Figure 7:
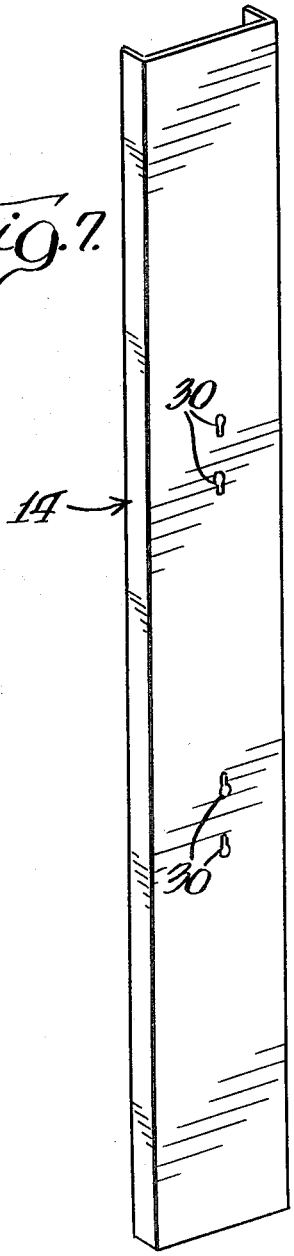
Figure 8:
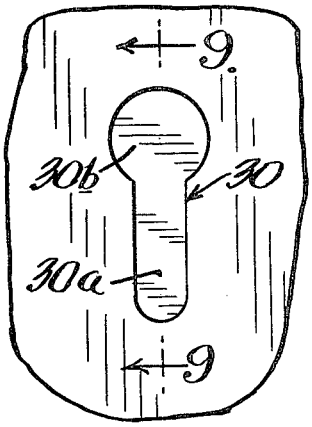
FIG. 8 is a fragmentary elevational view on a greatly enlarged scale of a keyhole knockout shown in FIGS. 6 and 7.
Figure 9:
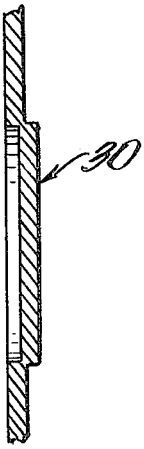
FIG. 9 is a fragmentary sectional view taken substantially as indicated along the line 9—9 of FIG. 8.

Referring to the drawings in detail, and referring first to FIG. 1, a modular, sheet metal door 10 is suspended by means of hanger bolts 11 from a carriage 12 which moves along a track 13. The illustrated door may be either a car door or a hatch door. If it is the former, the track is mounted on the top of the elevator car; while if it is the latter, the track is mounted upon the building wall above the hatch doorway.

The modular door structure 10 consists of a plurality of vertically extending sheet metal modules which are all of the same length, and the modules include a median module 14 flanked by lateral modules 15 and 16, which in turn are flanked by additional lateral modules 17 and 18. A sheet metal sheath, indicated generally at 19, and identical sheet metal header means, indicated generally at 20, complete the illustrated door structure. Means 31 fixedly connecting the modules to one another, to the sheath, and to the header means, preferably consists of appropriately located welds.

The lateral modules 15, 16, 17 and 18 are all standardized units which may be made in any desired width. Because of the substantial variations in overall door width, the median module 14 is ordinarily custom built for each job, so that minor variations in door width from job to job are accommodated entirely by the width of the median module.

Each of the lateral modules has a main web, and said webs in the illustrated door structure are indicated, respectively, as 15*a*, 16*a*, 17*a* and 18*a*. Those main webs, together with a main web 14*a* of the median module 14, are all coplanar and form most of an unfinished surface of the door.

Each of the lateral modules also has an inner side web which is perpendicular to the main web, and said inner side webs are indicated, respectively, by the reference numerals 15*b*, 16*b*, 17*b* and 18*b*. Integral with the respective inner side webs are connecting webs 15*c*, 16*c*, 17*c* and 18*c*, each of which extends toward the vertical median plane of the door and has a surface flat against a body 19*a* of the sheath 19. Each of the lateral modules also has an outer side web parallel to its inner side web, and said outer side webs are identified by the respective reference numerals 15*d*, 16*d*, 17*d* and 18*d*. Each of the outer side webs has an edge which is adapted to face a connecting web of a lateral module which is more remote from the vertical median plane of the door, as the edge of the outer side web 15*d* is seen to face the connecting web 17*c*, and the outer side web 16*d* faces the connecting web 18*c*.

The median module 14 has side webs 14*b* the edges of which face the connecting webs 15*c* and 16*c* of the lateral modules 15 and 16 which are directly connected to it.

The sheet metal sheath 19, in addition to the body 19*a*, has upright marginal portions 19*b* which provide the upright sides of the door, and marginal flanges 19*c* which are welded to the module main webs 17*a* and 18*a*. The sheet metal sheath 19 is seen to have extremities 19*d* which extend above and below the ends of the modules 14–18, and the header means 20 are recessed in said extremities 19*d*.

Each of the headers 20 is seen to consist of a box beam which has an inner wall 21 welded to the ends of the modules 14–18, side walls 22, and a wall 23 which forms an extremity of the door and is provided with a continuous longitudinal slot 24 flanked by marginal web portions 25 which are turned inwardly perpendicular to the wall 23. The mounting of the headers with their slotted walls 23 forming the extremities of the door 10 permits the door to be hung from the carriage 12 with either end uppermost.

For mounting the door, a hanger plate, indicated generally at 26, is a shallow channel having a base 27 which spans the slot 24, and side flanges 28 which lie outside the inturned web portions 25 of the upper header 20. The base 27 of the hanger plate 26 has holes surrounded by threaded nuts 29 which are welded to the hanger plate, and the threaded hanger bolts 11 which have their heads 11*a* seated upon flanges of carriage brackets 12*a* are screwed through the hanger plate nuts 29 and bear upon the bottom wall 21 of the header 20 to draw the hanger plate 26 firmly agsinst the inturned web portions 25.

Connection of a door operating mechanism to the door is facilitated by providing at least the median module 14 and the lateral module 15 with keyhole shaped knockouts 30 each of which has a narrow end 30*a* and a larger end 30*b*. The keyhole knockouts are grouped above and below the transverse median plane of the door, and the knockouts of each group have their larger end portions 30*b* toward the adjacent extremity of the door. Thus, whichever end of the door is uppermost, keyhole openings formed from selected keyhole knockouts toward the upper end of the door have their enlarged portions 30*b* toward the top.

The foregoing detailed description has been given for clearness of understanding only and no unnecessary limitations should be understood therefrom as modifications will be obvious to those skilled in the art.

We claim:

1. A modular sheet metal door structure for use in a location where only one surface and the upright door sides must present a finished appearance, said structure comprising, in combination:

a plurality of upright sheet metal modules of the same length, each said module having a main web that forms a part of the unfinished surface of the door, and side webs perpendicular to said main web, and said modules having their main webs coplanar and their side webs abutting;

a one-piece sheet metal sheath having a body which forms the entire finished surface of said door, said sheath having upright marginal portions which closely embrace the modules to provide the finished upright door sides, and the body of said sheath abutting the edges of at least some of the module side webs;

means fixedly connecting said modules to one another and to said sheath;

and header means fixedly secured to the upper and lower ends of said modules to provide the ends of the door.

2. The combination of claim 1 in which the sheath extends above and below the upper and lower ends of the modules, and the header means are concealed by the sheath.

3. The combination of claim 1 in which the header means are identical box beams each of which has a side forming an extremity of the door, and in which said side of each header means has a longitudinal slot flanked by marginal portions which are turned inwardly perpendicular to said side, whereby mounting plates may be positioned in the upper box beam abutting said inwardly turned marginal portions to receive upright stems on which the door is hung from overhead supporting means, and whereby the door may be hung with either end up.

4. The combination of claim 3 in which the overhead supporting means comprises a transverse track, a plurality of carriages are mounted for movement along said track, and the upright stems are carried upon said carriages so the door may be moved sideways.

5. The combination of claim 4 in which at least some of said module main webs have knockouts to receive bolts for connecting a door operating mechanism to the door.

6. The combination of claim 5 in which the knockouts are keyhole slots which have larger and smaller portions and which have their long dimensions upright.

7. The combination of claim 6 in which the keyhole slots above and below the transverse median plane of the door are oppositely oriented, and all have their larger portions toward the nearer end of the door.

8. The combination of claim 1 in which a lateral module at each side of the door has an inner side web and a connecting web integral with said inner side web which extends toward the vertical median plane of the door and has a surface flat against the sheath body, and in which a median module has two side webs the edges of which face the connecting webs of lateral modules which are directly connected to it.

9. The combination of claim 20 in which each lateral module has an outer side web the edge of which is adapted to face a connecting web of a lateral module which is more remote from the vertical median plane of the door.

10. A modular sheet metal door structure comprising, in combination:

a plurality of upright sheet metal modules of the same length fixedly connected to one another, said modules having coplanar main webs that form a surface of the door;

and identical header means fixedly secured to the upper and lower ends of said modules, each of said header means comprising a box beam which has a side forming an extremity of the door and said side has a continuous longitudinal slot flanked by marginal portions which are turned inwardly perpendicular to said side, whereby mounting plates may be positioned in the upper box beam abutting said inwardly turned marginal portions to receive upright stems on which the door is hung from overhead supporting means, and whereby the door may be hung with either end up.

11. The combination of claim 10 in which the overhead supporting means comprises a transverse track, a plurality of carriages are mounted for movement along said track, and the upright stems are carried upon said carriages so the door may be moved sideways.

12. The combination of claim 11 in which at least some of said module main webs have knockouts to receive bolts for connecting a door operating mechanism to the door.

13. The combination of claim 12 in which the knockouts are keyhole slots which have larger and smaller portions and which have their long dimensions upright.

14. The combination of claim 13 in which the keyhole slots above and below the transverse median plane of the door are oppositely oriented, and all have their larger portions toward the nearer end of the door.

15. A modular sheet metal door structure comprising, in combination:

a plurality of upright sheet metal modules of the same length fixedly connected to one another, said modules having coplanar main webs forming one surface of the door, lateral modules of said plurality having an inner side web perpendicular to the main web, a connecting web integral with said inner side web which extends toward the vertical median plane of the door in a plane parallel to said main webs, and an outer side web parallel to the inner side web which is narrower than said inner side web, and a median one of said modules having parallel side webs with edges facing the connecting webs of adjacent lateral modules which are directly connected to it;

a sheet metal sheath abutting and fixedly secured to said connecting webs to form the other surface of the door;

and sheet metal header means fixedly secured to the upper and lower ends of said modules to provide the ends of the door.

16. The combination of claim 15 which includes a pair of lateral modules flanking said adjacent lateral modules, each of said pair of lateral modules having an inner side web substantially abutting the outer side web of a contiguous adjacent lateral module having a connecting web integral with its inner side web and extending toward the vertical median plane of the door parallel to the main web of said contiguous module.

17. The combination of claim 15 in which the header means are box beams each of which has a side forming an extremity of the door, and in which said side of each header means has a longitudinally slot flanked by marginal portions which are turned inwardly perpendicular to said side, whereby mounting plates may be positioned in the upper box beam abutting said inwardly turned marginal portions to receive upright stems on which the door is hung from overhead supporting means, and whereby the door may be hung with either end up.

18. The combination of claim 17 in which the overhead supporting means comprises a transverse track, a plurality of carriages are mounted for movement along said track, and the upright stems are carried upon said carriages so the door may be moved sideways.

19. The combination of claim 18 in which at least some of said module main webs have knockouts to receive bolts for connecting a door operating mechanism to the door.

20. The combination of claim 19 in which the knockouts are keyhole slots which have larger and smaller portions and which have their long dimensions upright.

21. The combination of claim 20 in which the keyhold slots above and below the transverse median plane of the door are oppositely oriented, and all have their larger portions toward the nearer end of the door.

22. A modular sheet metal door structure for use in a location where only one surface and the upright door sides must present a finished appearance, said structure comprising, in combination:

a plurality of upright sheet metal modules of the same length, each said module having a main web that forms a part of the unfinished surface of the door, and side webs perpendicular to said main web, said modules including a lateral module at each side of the door which has an inner side web and a connecting web integral with said inner side web which extends toward the vertical median plane of the door in a plane parallel to that of the main web, and a median module which has two side webs the edges of which face the connecting webs of lateral modules which are directly connected to it, and said modules having their main webs coplanar and their side webs side by side;

a one-piece sheet metal sheath having a body which forms the entire finished surface of said door, said sheath having upright marginal portions which closely embrace the modules to provide the finished upright door sides, and the body of said sheath abutting the edges of at least some of the module side webs and lying flat against the connecting webs of the lateral modules;

means fixedly connecting said modules to one another and to said sheath;

and identical sheet metal header means fixedly secured to the upper and lower ends of said modules to provide the ends of the door.

23. The combination of claim 10 which includes a one-piece sheet metal sheath having a body which furnishes one entire surface of said door and extends above and below the upper and lower ends of the modules so as to conceal one side of the header means, the body of said sheath abutting and being secured to a part of each of said modules, and said sheath having upright marginal portions which closely embrace the modules and the ends of the headers to provide finished upright door sides.

24. A modular sheet metal door structure for use in a location where only one surface and the upright door sides must present a finished appearance, said structure comprising, in combination:

a plurality of sheet metal modules of the same length, each said module having a main web that forms a part of the unfinished surface of the door, and side webs perpendicular to said main web, and said modules having their main webs coplanar and their side webs side by side;

a one-piece sheet metal sheath having a body which forms the entire finished surface of said door, said sheath having upright marginal portions which closely embrace the modules to provide the finished upright door sides, and the body of said sheath abutting the edges of at least some of the module side webs;

means fixedly connecting said modules to one another and to said sheath;

and identical header means fixedly secured to the upper and lower ends of said modules to provide the ends of the door, the header means being box beams each of which has a side forming an extremity of the door, and in which said side of each header means has a continuous longitudinal slot flanked by marginal portions which are turned inwardly perpendicular to said side, whereby mounting plates may be positioned in the upper box beam abutting said inwardly turned marginal portions to receive upright stems on which the door is hung from overhead supporting means, and whereby the door may be hung with either end up.

25. The combination of claim 24 in which the sheath extends above and below the upper and lower ends of the modules, and one side and the ends of the header means are concealed by the sheath.

26. The combination of claim 24 in which the overhead supporting means comprises a transverse track, a plurality of carriages are mounted for movement along said track, and the upright stems are carried upon said carriages so the door may be moved sideways.

* * * * *